US005806921A

United States Patent [19]

LaPointe et al.

[11] Patent Number: 5,806,921

[45] Date of Patent: Sep. 15, 1998

[54] MODULAR RECLINING CHAIR HAVING IMPROVED CHAIR FRAME AND PANTOGRAPH LINKAGE

[75] Inventors: Larry P. LaPointe, Temperance; Dennis W. Wright, Monroe; Karl J. Komorowski, Petersburg, all of Mich.

[73] Assignee: La-Z-Boy Incorporated, Monroe, Mich.

[21] Appl. No.: 729,551

[22] Filed: Oct. 11, 1996

Related U.S. Application Data

[63] Continuation-in-part of Ser. No. 429,105, Apr. 26, 1995, Pat. No. 5,570,927, which is a continuation-in-part of Ser. No. 321,079, Oct. 14, 1994, abandoned, which is a continuation-in-part of Ser. No. 230,541, Apr. 20, 1994, Pat. No. 5,427,431, which is a division of Ser. No. 897,546, Jun. 18, 1992, Pat. No. 5,323,526, which is a continuation-in-part of Ser. No. 819,784, Jan. 13, 1992, Pat. No. 5,222,286, which is a continuation-in-part of Ser. No. 772,231, Oct. 11, 1991, Pat. No. 5,301,413.

[51] Int. Cl.[6] ..... A47C 1/02

[52] U.S. Cl. ..... 297/85; 297/440.1; 297/DIG. 7

[58] Field of Search ..... 297/DIG. 7, 440.1, 297/85, 68, 83, 84, 342, 341, 423.1, 258.1, 440.14, 423.19

[56] References Cited

U.S. PATENT DOCUMENTS

| | | | |
|---|---|---|---|
| 3,096,121 | 7/1963 | Knaubusch et al. . | |
| 3,325,210 | 6/1967 | Knabusch et al. . | |
| 4,179,157 | 12/1979 | Shoemaker et al. . | |
| 4,236,754 | 12/1980 | Ehlers | 297/423.1 |
| 4,367,895 | 1/1983 | Pacitti et al. . | |
| 4,861,101 | 8/1989 | Hartline . | |
| 5,141,284 | 8/1992 | LaPointe . | |
| 5,222,286 | 6/1993 | Saul et al. . | |
| 5,288,126 | 2/1994 | Saul et al. . | |
| 5,301,413 | 4/1994 | Habegger et al. . | |
| 5,323,526 | 6/1994 | Saul et al. . | |
| 5,427,431 | 6/1995 | Saul et al. . | |
| 5,435,621 | 7/1995 | Komorowski et al. . | |
| 5,570,927 | 11/1996 | LaPointe et al. . | |

*Primary Examiner*—Milton Nelson, Jr.
*Attorney, Agent, or Firm*—Harness, Dickey & Pierce, P.L.C.

[57] ABSTRACT

A modular reclining chair having an improved chair frame assembly and improved pantograph linkage is disclosed. The chair frame assembly includes a hybrid front frame member assembly having a plywood front frame board and a pair of metal front frame brackets for interconnecting a pair of side frame assemblies to define a rigid box-like chair frame. The front frame member assembly is further interconnected with the actuation mechanism to provide an integrated chair frame assembly. The improved pantograph linkage is adapted to be readily removable from a fully assembled chair for facilitating field serviceability and repair without requiring partial or complete disassembly of the reclining chair.

20 Claims, 6 Drawing Sheets

40
10
36
38
14
42
34
22
42
54
40
18
54
16
46
60
44
28
26
32
72
64
30
32
30
24
18
62
20
12

76
74
66
26
72
50
48
52
46
60
68
58
56
54
4
44
94
94a
94b
94c
94d 264
266
270
262
268
256
260
258

240
236
220
210

214
226
248
238
218
242
216
224
228
244
274
272
278
276
230
246
280
282
222
264
250
212
256
258
232
254
252
234
252

MODULAR RECLINING CHAIR HAVING IMPROVED CHAIR FRAME AND PANTOGRAPH LINKAGE

CROSS-REFERENCE TO RELATED APPLICATIONS

This is a continuation-in-part of U.S. application Ser. No. 08/429,105, filed Apr. 26, 1995 (now U.S. Pat. No. 5,570,927), which is a continuation-in-part of U.S. application Ser. No. 08/321,079, filed Oct. 14, 1994 (now abandoned), which is a continuation-in-part of U.S. application Ser. No. 08/230,541, filed Apr. 20, 1994 (now U.S. Pat. No. 5,427,431), which is a divisional of U.S. application Ser. No. 07/897,546, filed Jun. 18, 1992 (now U.S. Pat. No. 5,323,526), which is a continuation-in-part of U.S. application Ser. No. 07/819,784, filed Jan. 13, 1992 (now U.S. Pat. No. 5,222,286), which is a continuation-in-part of U.S. application Ser. No. 07/772,231, filed Oct. 11, 1991 (now U.S. Pat. No. 5,301,413).

BACKGROUND OF THE INVENTION

The present invention relates generally to reclining chairs and more particularly to a modular reclining chair having an improved chair frame assembly and an improved pantograph linkage mechanism which simplifies assembly and repair of the modular reclining chair.

Recent developments in the design and fabrication of various articles of furniture, and in particular reclining chairs, has resulted in the replacement of the "chair within a chair" design by the integrated chair design. The integrated or "knock down" construction of a reclining chair utilizes unique fabrication and assembly techniques which effectively result in increased production efficiency and cost savings while concomitantly producing a high quality article of furniture. In general, the construction of these integrated reclining chairs is such that a preassembled actuation mechanism is integrated into pre-upholstered frame components which, when assembled, are rigidly interconnected to define a "box-like" chair frame. In this manner, the conventional construction of supporting the actuation mechanism within a separate and distinct frame assembly is no longer required. The preassembled actuation mechanism includes a drive rod and a front support shaft which are supported by and suspended between left and right upholstered side frame assemblies. Front and rear frame rail members interconnect the left and right side frame assemblies to define a "unitized" and rigid box-like chair frame which minimizes side-to-side movement of the actuation mechanism suspended therein, as well as lateral flexion of the side assemblies themselves.

In this regard, various front frame assemblies have been utilized. For example, a four-piece, all-metal front frame rail member is disclosed in U.S. Pat. No. 5,435,621 and an all-wood front cross-member assembly is disclosed in U.S. Pat. No. 5,382,073. While each of these designs function adequately to provide a rigid chair frame assembly, continuous efforts have been made to improve the structural rigidity and the simplicity of manufacturing modular reclining chairs, as well as the suitability of various materials, i.e. metal components, hardwood components, plywood components. Accordingly, there is a continuing need to improve and optimize the design of the components of the chair frame assembly.

A major benefit of the "knock-down" assembly can be found in its ability to fabricate a wide variety of reclining-type chairs. For example, the same chair frame and assembly process can be utilized to construct a reclining rocking chair, a reclining wall proximity chair, a linkage reclining chair, a reclining glider chair, or other similar reclining motion chairs. While the integrated modular chair and "knock down" method of assembly has achieved great success in the marketplace, concerns have arisen regarding its repairability and serviceability after initial assembly. More specifically, the leg rest assembly and pantograph linkage mechanism are components which occasionally become damaged as a result of improper use of the reclining chair. For example, certain links within the pantograph linkage may become bent as a result of improper loading when positioned in the extended position. Thus, the pantograph linkage mechanism must be replaced to restore the reclining chair to its proper operating condition. This procedure has heretofore required major disassembly of the reclining chair. For example, the front frame rail member and at least one of the side frame assemblies must be removed to enable the support rod to be removed, thus freeing the pantograph linkage assembly. Accordingly, there is a need to provide an improved pantograph linkage which can be readily removed from the chair frame assembly to facilitate field serviceability and repair.

SUMMARY OF THE INVENTION

In accordance with the principles of the present invention, a reclining chair having an improved chair frame assembly and an improved pantograph linkage mechanism is disclosed which is designed to overcome the disadvantages traditionally associated with fabricating assembly and upholstering articles of furniture, and more specifically modular reclining chairs. Therefore, a primary object of the present invention is to provide a reclining chair which can be simply, efficiently and rigidly assembled so as to significantly reduce its overall complexity, weight, and cost, while providing improved operation and comfort to the seat occupant, as well as improved field serviceability.

It is an additional object of the present invention to provide a hybrid front frame member assembly which utilizes metal components and plywood components for increasing the structural integrity and rigidity of the chair frame assembly, while simplifying the assembly and reducing the cost thereof.

It is another object of the present invention to provide an improved reinforcement structure including spacer links interconnected between the actuation mechanism and the front frame member assembly.

It is still another object of the present invention to further adapt the improved chair frame assembly for use in a broad range of motion-type chairs by providing a stop assembly for rigidly interconnecting the chair frame assembly to the base assembly when the reclining chair is in its full, upright position.

It is yet another object of the present invention to provide an improved pantograph linkage mechanism which is readily detachable from the actuation mechanism of a fully assembled reclining chair, thereby improving serviceability thereof.

In a preferred embodiment of the present invention, the integrated or modular chair frame assembly includes a pair of side assemblies fabricated principally from plywood components which are interconnected at a rear portion by a metal rear frame rail and at a forward portion by a hybrid metal-plywood front frame member assembly. An actuation mechanism including a drive rod and a front support rod is suspended within the chair frame and may be operably coupled to a variety of motion linkage assemblies, such as a swing-link mechanism for operably coupling the seat assembly for reclining the seat back with respect to the seat member, a leg rest assembly having an improved pantograph linkage mechanism in which the curved link extending from the support shaft is detachable therefrom for facilitating field serviceability of the leg rest assembly in the reclining chair or a tilting mechanism for tilting the chair frame with respect to the base assembly.

Alternate embodiments of the present invention include a glider mechanism having an improved lower support link interconnected between the drive rod and the front frame member assembly which enhances the structural rigidity of the chair frame and a wall proximity reclining chair having a stop assembly which positively positions the chair in the full, upright position.

Additional objects, advantages and features of the present invention will become apparent from the following description and appended claims, taken in conjunction with the accompanying drawings.

DETAILED DESCRIPTION OF THE INVENTION

In accordance with the teaching of the present invention, an improved chair frame assembly for use in single and multi-person articles of furniture (i.e., chairs, sofas or loveseats) is disclosed. In addition, an improved pantograph linkage mechanism for use in chairs having an extendable leg rest assembly is disclosed. As such, the present invention is readily adaptable to a "known down" method of assembly in which the actuation mechanism is a preassembled and "integrated" component of the reclining-type chair. The preassembled actuation mechanism is suspended from the frame component so as to provide precise mechanical alignment and superior structural rigidity while employing a highly efficient fabrication and assembly process. As presently preferred, the reclining chair is capable of a variety of relative motions, namely independent recline of a seat back relative to a seat member, movement of a leg rest assembly between retracted and extended positions, and relative motion between the chair frame and the base assembly such as rocking, tilting, gliding and translating. Moreover, a full range of independent reclining movement of the seat back relative to the seat member is possible regardless of the operative position of the leg rest assembly between the retracted and extended positions.

Figure 1:
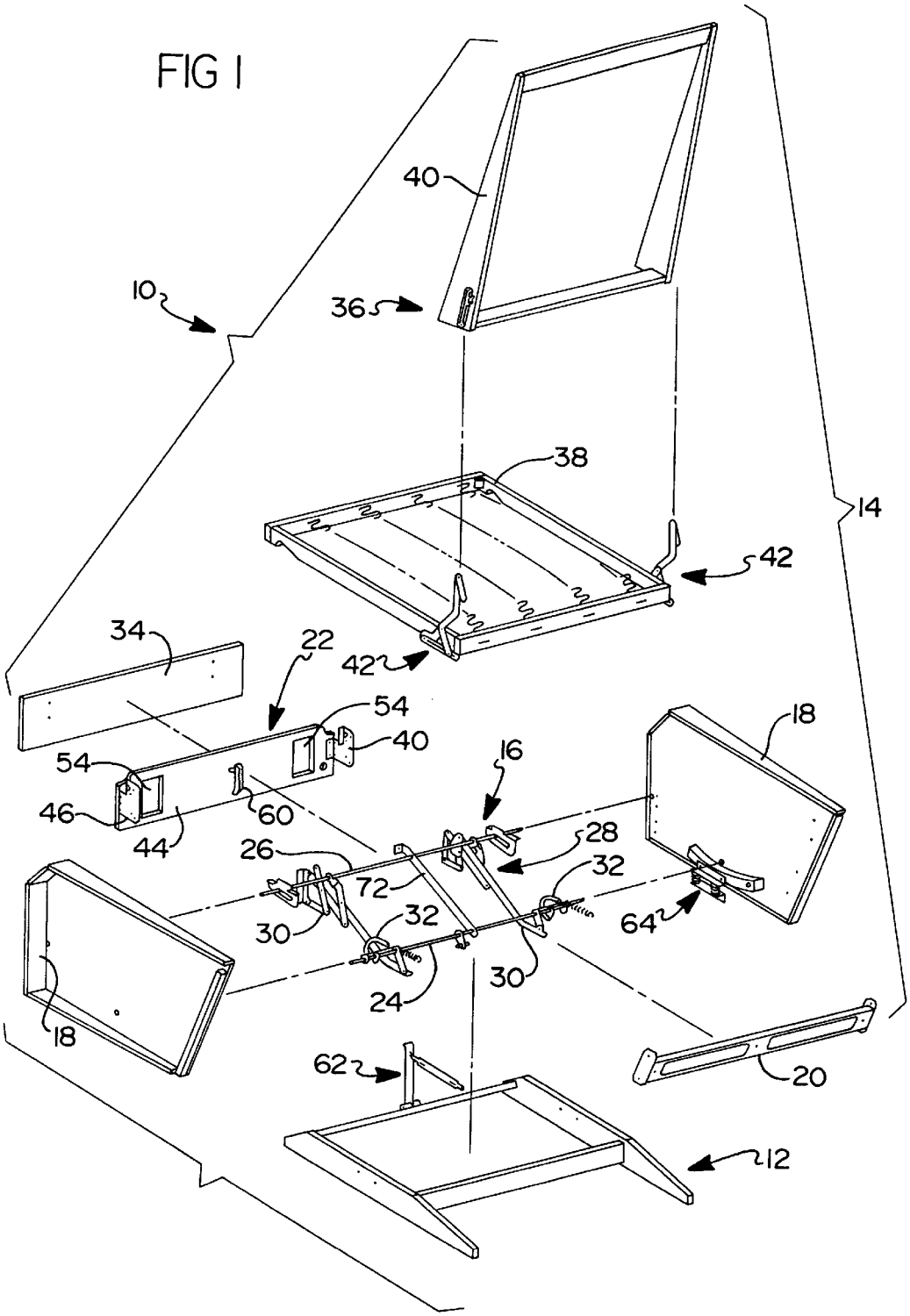
FIG. 1 is an exploded perspective view of a modular reclining rocking chair in which the upholstery, spring and other components have been removed from the frame components for illustrating their integrated and interdependent association with the improved chair frame assembly and the improved pantograph linkage assembly of the present invention.

With particular reference now to the drawings, the functional and structural aspects of the present invention will now be described. As best shown in FIG. 1, the various preassembled frame components are illustrated which can be rapidly and rigidly assembled in a relatively easy and efficient manner. As presently preferred, all of the frame components are individually fabricated or subassembled to include the requisite brackets, springs, padding and upholstery in an "off line" batch-type basis. Subsequently, these preassembled frame components are modularly assembled for totally integrating the actuating mechanism therein.

Figure 2:
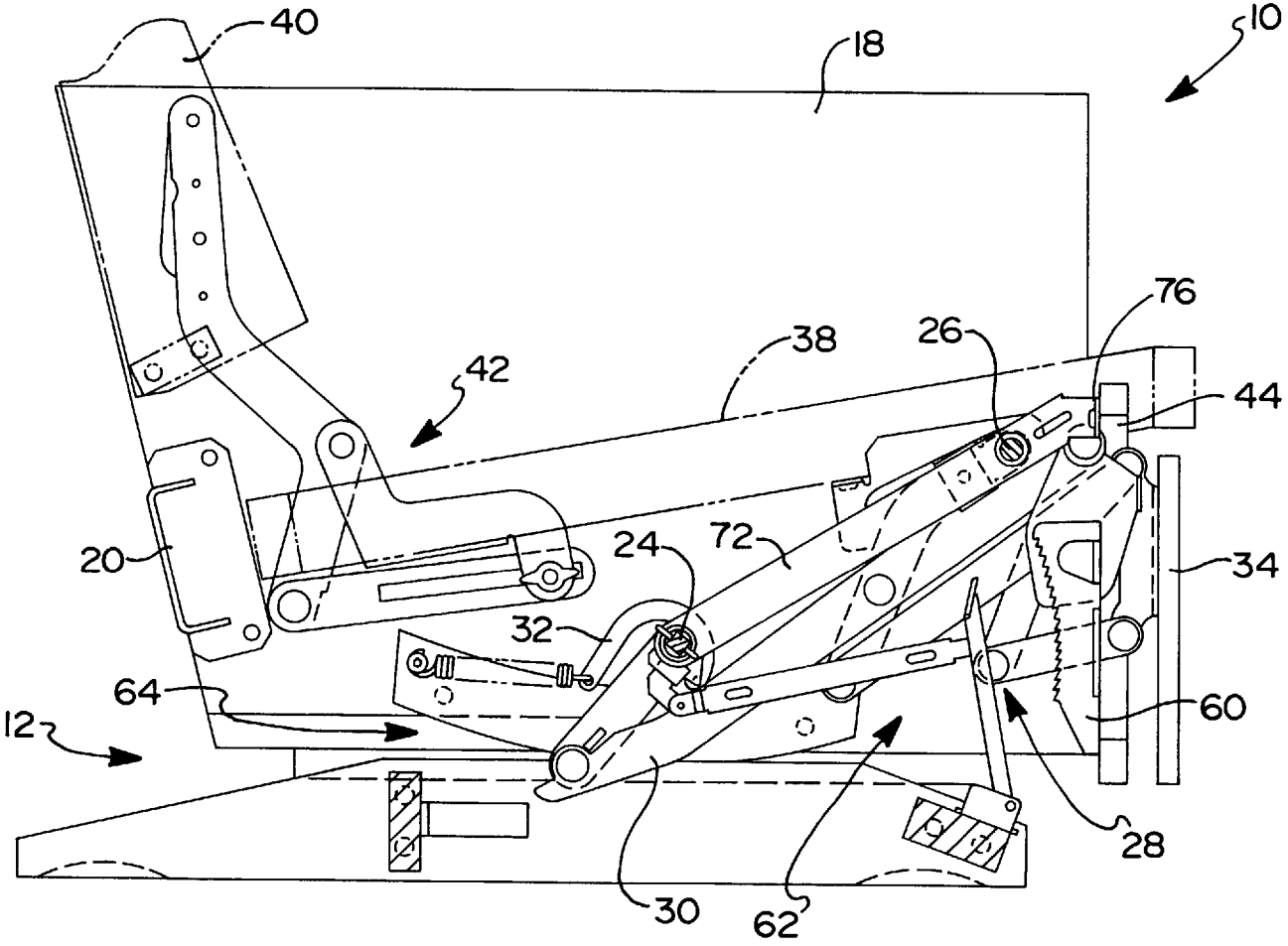
FIG. 2 is a partial sectional side view of the reclining chair shown in FIG. 1.

FIG. 2 illustrates the present invention incorporated into reclining rocking chair 10. Reclining rocking chair 10 is substantially similar in function and structure to the chairs illustrated and disclosed in U.S. Pat. No. 5,382,073 issued on Jan. 17, 1995 and U.S. Pat. No. 5,435,621 issued on Jul. 25, 1995 which are commonly owned by the assignee of the present invention and the disclosures of which are expressly incorporated by reference herein. Accordingly, only those aspects of reclining rocking chair 10 which relate to the present invention will be described in detail herein. A more detailed description of the mechanisms associated with this type of chair can be found in the above-identified United States patents incorporated by reference herein.

Reclining rocking chair 10 includes base 12 supporting chair frame assembly 14 for relative rocking motion therebetween and actuation mechanism 16 operatively suspended from chair frame assembly 14. Chair frame assembly 14 includes side frame assemblies 18 interconnected at a rear edge by rear frame rail member 20 and interconnected at a front edge by front frame member assembly 22 to define a rigid "box-like" chair frame. Actuation mechanism 16 is preassembled to include drive rod 24 and front support shaft 26, both of which are spatially oriented to be precisely located and suspended from side frame assembly 18. Actuation mechanism 16 is shown to support leg rest assembly 28 thereon. More specifically, leg rest assembly 28 includes left and right pantograph linkages 30 and left and right spring assisted toggle mechanisms 32, both of which are operably associated with drive rod 24 and front support shaft 26 for retracting and extending leg rest board 34 in response to rotation of drive rod 24. Seat assembly 36 is located between and supported for reclining movement on side frame assemblies 18 and includes seat member 38 and seat back 40 operably interconnected by swing link mechanism 42.

Figures 3, 4, 6B, 6C, 6D:
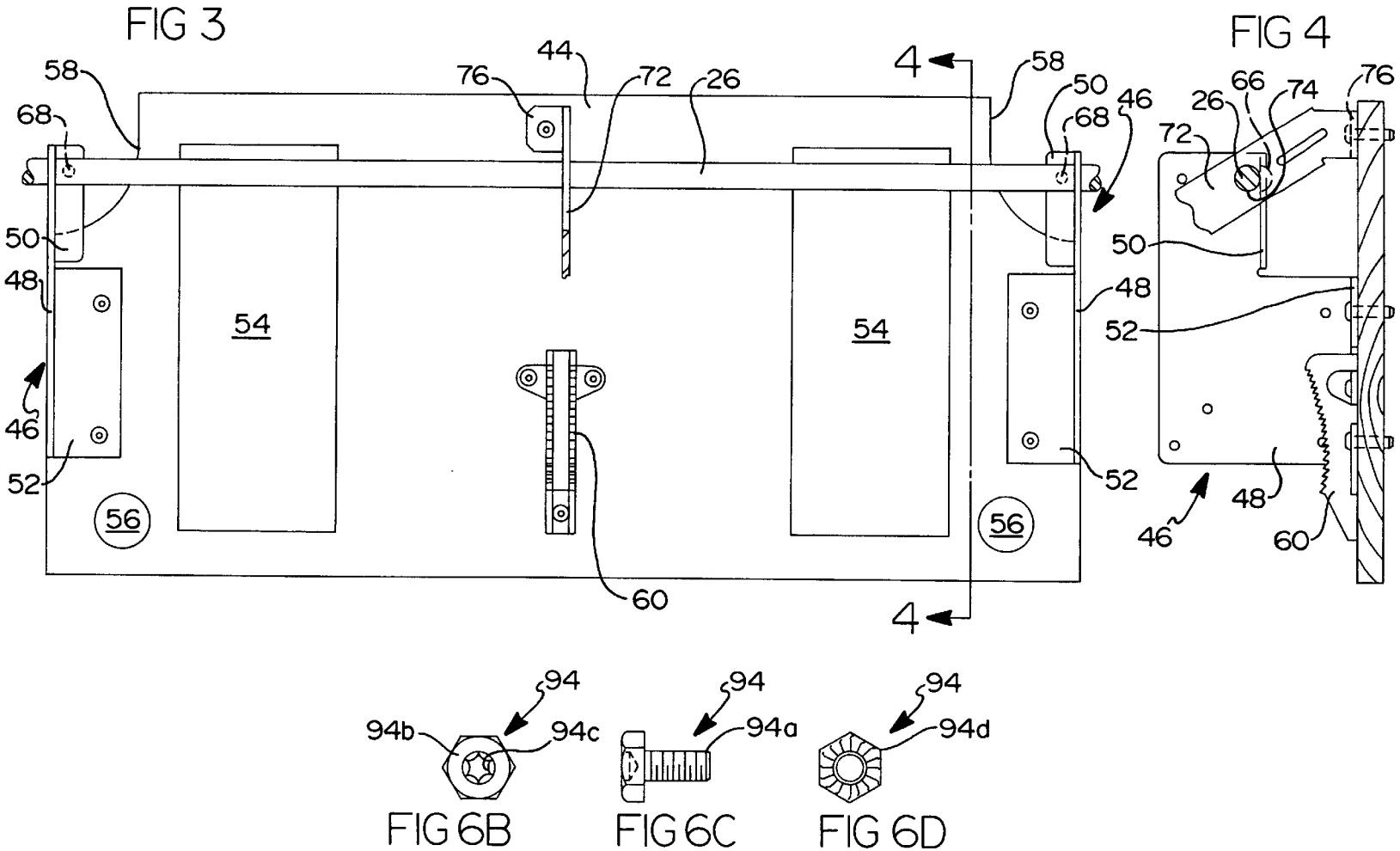
FIG. 3 is an elevational view looking forwardly towards the improved front frame member assembly.
FIG. 4 is a simplified sectional view taken along line 4—4 of FIG. 3.
FIG. 6B is a top view of the self-tapping hex-torx bolt shown in FIG. 5.
FIG. 6C is a side view of the self-tapping hex-torx bolt shown in FIG. 5.
FIG. 6D a bottom view of the self-tapping hex-torx bolt shown in FIG. 5.

With reference now to FIGS. 2–4, front frame member assembly 22 is shown. As can be seen in FIG. 3, front frame member assembly 22 is a multi-piece assembly including front frame board 44 and a pair of front frame brackets 46 extending from opposite lateral ends of front frame board 44. Front frame member assembly 22 is a hybrid assembly having plywood front frame board 44 and metal front frame brackets 46 which are integrally coupled with front support shaft 26. This hybrid assembly incorporates the high stiffness, ease of upholstering, reduction of noise and lowering of costs provided by a plywood front end with the ability to integrally couple front frame member assembly 22 with actuation mechanism 16 provided by metal end brackets. Front frame brackets 46 include plate portion 48 having upper and lower flange 50, 52 extending laterally inwardly towards the centerline of reclining chair 10. Lower flange 52 is formed forwardly of upper flange 50 and includes a plurality of apertures for receiving fasteners to secure front frame board 44 to front frame bracket 46. Similarly, plate portion 48 includes a plurality of apertures for receiving fasteners to secure front frame member assembly 22 with side frame assembly 18. As best seen in FIG. 3, front frame board 44 is formed out of ¾" thick plywood and includes a pair of rectangular openings 54 which permits pantograph linkage 30 to extend therethrough. Blind bore 56 is provided in a rear surface of front frame board 44 to provide clearance for various linkage mechanisms which may optionally be incorporated into reclining chair 10. Front frame board 44 also includes arcuate relief 58 formed at the upper corners thereof adjacent front frame brackets 46 to provide clearance for swing link mechanism 42 during reclining movement of reclining chair 10. Rachet sector 60 is centrally located on and secured to front frame board 44 with a plurality of threaded fasteners. Rachet sector 60 cooperates with pawl assembly 62 (shown in FIG. 1) for providing a positive lock-out mechanism of rocker assembly 64 interconnecting base 12 with chair frame assembly 14 to permit relative rocking motion.

Plate portion 48 of front frame bracket 46 has slot 66 formed therein for locating and retaining opposite ends of front support shaft 26. Upper flange 50 of front frame bracket 46 is generally parallel to but displaced inwardly from front frame board 44. A complimentary set of apertures 68 are formed through upper flange 50 and front support shaft 26 for receiving threaded fastener 70 therein to rigidly secure front support shaft 26 with front frame member assembly 22. In this way, actuation mechanism 16, and more specifically, front support shaft 26, becomes an integral part of chair frame assembly 14.

Spacer link 72 is interconnected between drive rod 24, front support shaft 26, and front frame board 44 to further integrate actuation mechanism 16 with chair frame assembly 14. More specifically, spacer link 72 is journally supported on drive rod 24 and extends forwardly and upwardly towards front support shaft 26. Thus, the rearward end of spacer link 72 is supported by drive rod 24, while permitting relative rotation therein. Front support shaft 26 extends through aperture 74 formed near the upper end of spacer link 72. Spacer link 72 extends forwardly and upwardly from front support shaft 26 and terminates at laterally extending flange 76. An aperture formed through laterally extending flange 76 receives a threaded fastener for securing the upper end of spacer link 72 to secure front support shaft 26 to spacer link 72 with front frame board 44. As such, actuation mechanism 16 is integrally coupled with chair frame assembly 14 to provide a rigid "box-like" chair frame assembly.

Referring now to FIGS. 5, 6A–6F, leg rest assembly 28 is shown to include leg rest board 34 having an outer surface that is padded and upholstered to provide a matching finished look with reclining chair 10. Leg rest board 34 is supported and moved by identical right and left-hand pantograph linkages 30, hereinafter referred to singularly, which are operably suspended from drive rod 24 and front support shaft 26. More specifically, pantograph linkage 30 includes drive link 80 having a square aperture formed at one end thereof for receiving drive rod 24. Similarly, pantograph linkage 30 is suspended from front support shaft 26 by leg rest swing bracket 84. Leg rest swing bracket 84 has an aperture formed in a first end thereof for receiving front support shaft 26. Leg rest swing arm 86 is releasably secured to leg rest swing bracket 84 and extends downwardly and forwardly to define a curved link.

Figures 5, 6A, 6E, 6F:
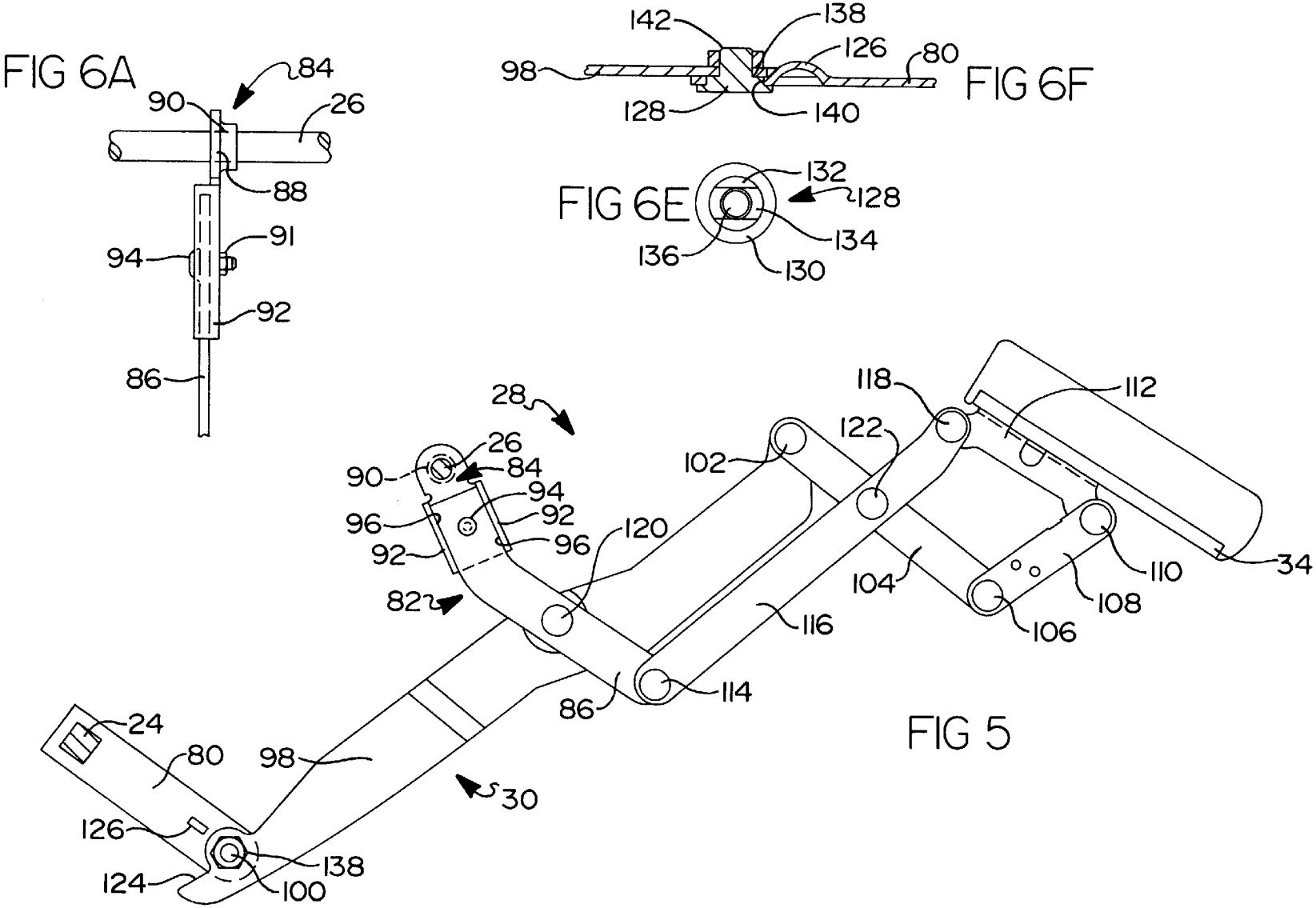
FIG. 5 is a side view of the improved pantograph linkage mechanism having a two-piece curved link releasably secured to the front support rod and a support link releasably secured to a drive link.
FIG. 6A is a partial detailed view of the two-piece curved link for the pantograph linkage mechanism illustrated in FIG. 5.
FIG. 6E is a partial detailed view of the pivotal connection between the drive link and the support link.
FIG. 6F is a detailed view of the shoulder bolt shown in FIG. 6E.

With particular reference to FIG. 6A, leg rest swing bracket 84 includes an upper tab portion 88 having an extruded hole formed therethrough to define collar 90. Front support shaft 26 extends through collar 90 such that leg rest swing bracket 84 is rotatably positioned thereon. Extruded collar 90 provides an increased bearing surface for supporting the loads exerted on leg rest assembly 28 without requiring a multiple-piece or multi-thickness component. In addition, collar 90 inhibits side-to-side movement of leg rest assembly 28, as well as reacts bending moments applied to leg rest swing bracket 84. Leg rest swing bracket 84 further includes flanges 92 extending approximately perpendicular from leg rest swing bracket 84 which capture an upper edge portion 96 of leg rest swing arm 86. Extruded collar 91, which is similar to collar 90, is formed in leg rest swing bracket 84 in between flanges 92 and has an aperture formed therethrough. A complimentary aperture is formed in leg rest swing arm 86 to receive threaded fastener 94 for releasably securing leg rest swing arm 86 to leg rest swing bracket 84. Extruded collar 91 locally increases the effective thickness of leg rest swing bracket 84 to prevent stripping of the aperture formed therethrough during repeated installation of threaded fastener 94. Flanges 92 engage the upper edge portions 96 of leg rest swing arm 86 to react relative to translational or rotational movement between leg rest swing bracket 84 and leg rest swing arm 86. Accordingly, only a single threaded fastener 94 is required to releasably secure leg rest swing arm 86 to leg rest swing bracket 84.

Referring now to FIGS. 6B, 6C and 6D, the details of threaded fastener 94 are illustrated. More specifically, threaded fastener 94 is a ¼"-20 UNC bolt having a self-tapping tip 94*a*, such as a Rockford HP-5 thread forming tip, formed on an end thereof. Head portion 94*b* is a ½" hexagonal shaped head which has a T-30 torx recess 94*c* formed therein. Accordingly, threaded fastener 94 can be manipulated using a plurality of tools such as a socket wrench or an open-end wrench, as well as a torx drive. This multi-functioned head permits the preferred use of a torx wrench during the assembly of reclining chair 10 and the preferred use of an open end wrench or socket during field service. The shoulder of head portion 94*b* which engages leg rest swing arm 86 has 18–24 locking serrations 94*d* formed thereon to provide a self-locking feature. Accordingly, threaded fastener 94 is a self-tapping, self-locking bolt which has the ability to be tightened and loosened with a variety of different tools.

By utilizing a self-tapping bolt for threaded fastener 94, leg rest swing bracket 84 can be formed using a progressive die. Furthermore, leg rest swing bracket 84 is designed such that extruded collars 90 and 91 and flanges 92 provides an extremely robust design which is substantially impervious to damage and which need not be removed from reclining chair 10 when pantograph linkage 30 is repair or replaced.

Referring now to FIGS. 6E and 6F, drive link 80 is releasably secured to support link 98 at pivot 100 by threaded fastener 128. More specifically, threaded fastener 128 is a shoulder bolt having a head portion 130, a generally cylindrical shoulder portion 132, a generally rectangular shoulder portion 134 and a threaded portion 136. As best seen in FIG. 6F, shoulder bolt 128 extends through cylindrical aperture 140 formed in drive link 80. Rectangular aperture 142 formed in support link 98 captures rectangular shoulder 134 to prohibit rotation of bolt 128. Nut 138 is preferably a ½" self-locking hex nut disposed on threaded portion 136 for releasably securing support link 98 to drive link 80. Thus, by utilizing a common wrench size, i.e. ½", for threaded fastener 94 and nut 138, leg rest swing arm 86 may be uncoupled from leg rest swing bracket 84 and support link 98 may be uncoupled from drive link 80 with the use of a single tool, thereby facilitating filed serviceability and repair.

With continued reference to FIG. 5, the remaining links of pantograph linkage 30 include support link 98 pivotally connected at pivot 102 with connection link 104, which is pivotally connected at pivot 106 to front board link 108 which is in turn pivotally connected at pivot 110 with leg rest bracket 112 secured to a rear surface of leg rest board 34. Similarly, leg rest swing arm 86 is pivotally connected at pivot 114 to rear board link 116 which is in turn pivotally connected at pivot 118 to leg rest bracket 112. Leg rest swing arm 86 is pivotally coupled at intermediate pivot 120 with support link 98. Rear board link 116 is pivotally coupled at intermediate pivot 122 with connection link 104.

Accordingly, selective rotation of drive rod 24 rotates drive link 80 which acts through pivot 100 to move support link 98. Such movement of support link 98 causes leg rest swing arm 86 to rotate about front support shaft 26 causing rear board link 116 to move outwardly and upwardly. In addition, the pivotal coupling of support link 98 with connection link 104 and front board link 108 results in coordinated upward and outward movement of front board link 108. This extensible movement takes place simultaneously with both left and right-hand pantograph linkages 30, thereby positioning leg rest board 34 between a "stowed" vertical position and an "extended" protracted position. The fully protracted position is limited when stop shoulder 124 formed on an end of support link 98 engages stop tap 126 formed in drive link 80.

As previously discussed, the design of pantograph linkage 30 is such that it is releaseably secured to actuation mechanism 16 for facilitating field serviceability. More particularly, after reclining chair 10 is fully assembled, leg rest assembly 28 may be readily removed from actuation mechanism 16 by the following process. Threaded fastener 94 releasably securing leg rest swing arm 86 to leg rest swing bracket 84 is removed. Similarly, bolt 128 and nut 138 are removed to uncouple support link 98 from drive link 80 at pivot 100. Accordingly, a majority of the components of pantograph linkage 30, including leg rest swing arm 86, support link 98, connection link 104, front board link 108, leg rest bracket 112, leg rest board 34, and rear board link 116, is uncoupled from actuation mechanism 16 and can be readily removed for service or replacement. Thus, the design of pantograph linkage 30 eliminates the need to substantially disassemble reclining chair 10 for service or replacement of leg rest assembly 28.

Figures 7, 8:
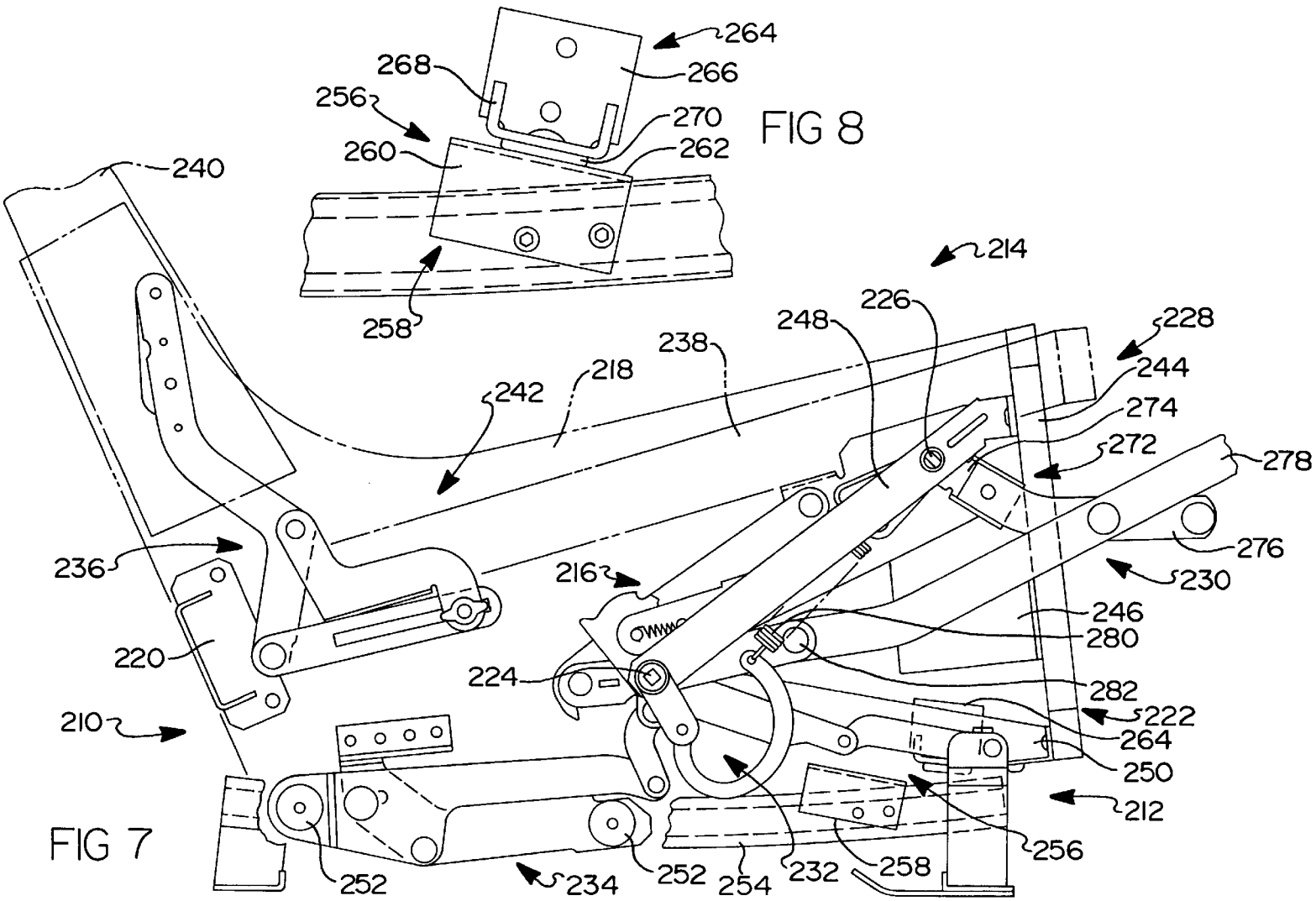
FIG. 7 is a side sectional view of a reclining wall proximity chair similar to the reclining rocking chair shown in FIG. 2.
FIG. 8 is a detailed side view of the stop bracket assembly for the reclining wall proximity chair shown in FIG. 7.

Referring now to FIGS. 7 and 8, an alternate embodiment of the present invention is incorporated into wall proximity reclining chair 210. Wall proximity chair 210 is substantially similar in function and structure to the chair illustrated and disclosed in U.S. application Ser. No. 08/429,105 filed on Apr. 26, 1995 which is commonly owned by the assignee of the present invention and the disclosure of which is expressly incorporated by reference herein. Accordingly, only those aspects of wall proximity reclining chair 210 which relate to the present invention will be described in detail herein. A more detailed description of the mechanisms associated with this type of reclining chair can be found in the above-identified United States patent application incorporated by reference herein.

Wall proximity reclining chair 210 includes base assembly 212 supporting chair frame assembly 214 which has actuation mechanism 216 suspend therefrom. Chair frame assembly 214 includes side frame assembly 218, rear frame rail member 220, and front frame member assembly 222. Actuation mechanism 216 includes drive rod 224 and front support shaft 226 suspended within side frame assemblies 218. Leg rest assembly 228 is suspended from and operably coupled to actuation mechanism 216 and includes pantograph linkage 230 and toggle linkage 232 for providing a protractable leg rest. Bearing link assembly 234 operably connects chair frame assembly 214 with base assembly 212 for permitting substantially linear translational movement of chair frame assembly 214 with respect to base 212, thus providing reclining movement of chair 210 while maintaining its proximity with an adjacent wall surface.

Seat assembly 236 is suspended between side frame assemblies 218 by swing linkage mechanism 242. More specifically, seat assembly 236 includes seat member 238 suspended at a forward portion between side frame assemblies 218 and supported by front support shaft 226 and supported at a rearward portion by swing linkage mechanism 242. Seat assembly 236 further includes seat back 240 operably coupled to seat member 238 and suspended from side frame assemblies 218 by swing linkage mechanism 242.

Front frame member assembly 222 of chair frame assembly 214 includes front frame board 244 having front frame brackets 246 disposed on opposite ends thereof for rigidly securing front frame member assembly 222 with side frame assemblies 218. In this regard, front frame member assembly 222 is substantially similar to front frame member assembly 22 previously described in conjunction with reclining rocking chair 10 illustrated in FIGS. 1–4. Upper spacer link 248 is journally supported at a rearward end from drive rod 224 and extends upwardly such that a forward end is secured to front frame board 244. In addition, front support shaft 226 is received through an aperture formed in upper spacer link 248, thereby connecting drive rod 224, front support shaft 226 and front frame member assembly 222. Similarly, lower spacer link 250 is journally supported from drive rod 224 and extends downwardly where a forward end thereof is fastened to a lower edge of front frame board 244 to further connect actuation mechanism 216 with chair frame assembly 214 for providing an extremely rigid chair frame assembly.

As previously discussed, chair frame assembly 214 is operably coupled to base assembly 212 for substantially linear translational movement during reclining motion thereof. More specifically, chair frame assembly 214 is coupled to left and right bearing link assembly 234 having wheels 252 which engage left and right track 254 extending from base 212 for permitting the translational movement. As such, chair frame assembly 218 is permitted to move forwardly and rearwardly with respect to base 212 as bearing link assembly 234 travels along track 254.

As presently preferred, wall proximity reclining chair 210 further includes stop assembly 256 for securely positioning chair frame assembly 214 with respect to base 212 when it is in the full upright position. Stop assembly 256 includes stop bracket 258 having vertical flange portion 260 with a pair of apertures formed therethrough for securing stop bracket 258 to track 254 with threaded fasteners. Lateral flange 262 extends from an upper edge of vertical flange 260 laterally inwardly towards the center of reclining chair 210. Stop mount 264 includes vertical flange 266 having a pair of apertures formed therethrough for securing stop mount 264 to side frame assembly 218 with threaded fasteners. Lateral flange 268 having a U-shaped cross-section extends laterally inwardly from a bottom edge of vertical flange 266 towards the centerline of reclining chair 210. Plastic bumper 270 is disposed on a bottom surface of lateral flange 268. Stop bracket 258 is angularly positioned with respect to track 254 such that lateral surface 262 extends rearwardly and upwardly. Similarly, stop mount 264 is angularly positioned with respect to side frame assemblies 218 such that lateral flange 268 is substantially parallel to lateral flange 262 so that plastic bumper 270 engages lateral flange 262 when reclining chair 210 is in the full upright position, as best seen in FIG. 8. As chair frame assembly 214 moves forwardly during reclining movement thereof, plastic bumper 270 moves forwardly and disengages lateral flange 262, thereby permitting chair 210 to recline while maintaining its proximity with an adjacent wall surface.

Referring again to FIG. 7, pantograph linkage 230 of wall proximity reclining chair 210 is substantially similar to pantograph linkage 30 previously described with respect to reclining rocking chair 10 and is readily detachable from actuation mechanism 216 for facilitating repair and serviceability thereof after complete assembly of wall proximity reclining chair 210. In this regard, leg rest swing link assembly 272 includes leg rest swing bracket 274 and leg rest swing arm 276 which are releasably secured together for permitting pantograph linkage 230 to be disconnected from front support shaft 226. Similarly, support link 278 is releasably secured to drive link 280 at pivot 282 for uncoupling pantograph linkage 230 from drive rod 224.

Figures 9, 10:
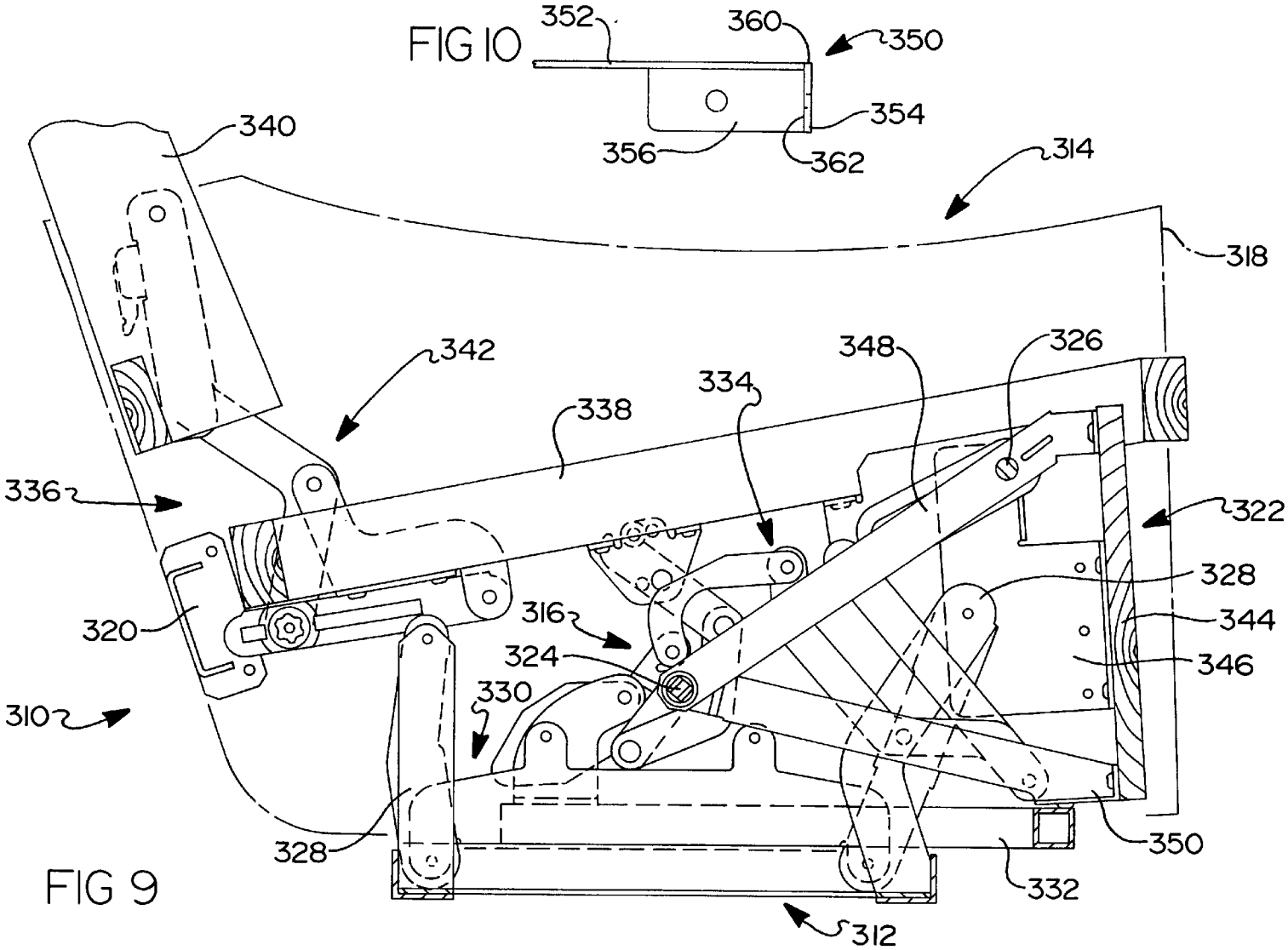
FIG. 9 is a side sectional view of a reclining gliding chair similar to the reclining rocking chair shown in FIG. 2.
FIG. 10 is a partial detailed view of the lower support link for the reclining gliding chair shown in FIG. 9.

Referring now to FIGS. 9 and 10, an alternate embodiment of the present invention incorporating a reclining gliding chair is illustrated. Reclining gliding chair 310 is substantially similar in function and structure to the chair illustrated and disclosed in U.S. application Ser. No. 08/429,105 filed on Oct. 18, 1995 which is commonly owned by the assignee of the present invention and the disclosure of which is expressly incorporated by reference herein. Accordingly, only those aspects of reclining gliding chair 310 which relate to the present invention will be described in detail herein. A more detailed description of the mechanisms associated with this type of chair can be found in the above-identified United States patent application incorporated by reference herein.

Reclining gliding chair 310 includes base assembly 312 supporting chair frame assembly 314 which has actuation mechanism 316 suspended therefrom. Chair frame assembly 314 includes side frame assembly 318, rear frame rail member 320, and front frame member assembly 322. Actuation mechanism 316 includes drive rod 324 and front support shaft 326 suspended within side frame assemblies 318.

Base assembly 312 includes glide uprights 328, cantilevered and extending upwardly therefrom. Glide mechanism 330 is interconnected between glide uprights 328 and subframe 332 for permitting gliding movement of chair frame 314 with respect to base assembly 312. Tilt mechanism 334 operably couples subframe 332 with chair frame assembly 314 to permit relative rearward tilting motion therebetween.

Seat assembly 336 is suspended between side frame assemblies 318 by swing linkage mechanism 342. More specifically, seat assembly 336 includes seat member 338 suspended at a forward portion between side frame assemblies 318 and supported by front support shaft 326 and supported at a rearward portion by swing linkage mechanism 342. Seat assembly 336 further includes seat back 340 operably coupled to seat member 338 and suspended from side frame assemblies 318 by swing linkage mechanism 342.

Front frame member assembly 322 of chair frame assembly 314 includes front frame board 344 having front frame brackets 346 disposed on opposite ends thereof for rigidly securing front frame member assembly 322 with side frame assemblies 318. In this regard, front frame member assembly 322 is substantially similar to front frame member assembly 22 previously described in conjunction with reclining rocking chair 10 illustrated in FIGS. 1–4. Upper spacer link 348 is journally supported at a rearward end from drive rod 324 and extends upwardly such that a forward end is secured to front frame board 344. In addition, front support shaft 326 is received through an aperture formed in upper spacer link 348, thereby connecting drive rod 324, front support shaft 326 and front frame member assembly 322.

Similarly, lower spacer link 350 is journally supported on drive rod 324 at a rearward end and extends downwardly where a forward end terminates at front frame board 344 and is secured thereto. With particular reference to FIG. 10, lower spacer link 350 includes longitudinal vertical flange 352 extending from drive rod 324 to front frame board 344. Transverse vertical flange 354 and lateral flange 356 are formed at a forward edge of longitudinal vertical flange 352. Transverse vertical flange 354 and lateral flange 356 are configured to transfer loads applied to the front portion of seat member 338 directly through front frame member assembly 322 into subframe 332, rather than through drive rod 324. More specifically, the forward edge 360 of longitudinal vertical flange 352 engages a rearward surface 362 of transverse vertical flange 354 such that any bending load applied to transverse vertical flange 354 is reacted through longitudinal vertical flange 352 and downwardly into lateral flange 356. Bumper 358 is interdisposed between lateral flange 356 and subframe 332 for providing a degree of compliance therebetween which acts to preload the various pivots and supports associated with tilt mechanism 334, glide mechanism 330 and actuation mechanism 316, thus limiting movement in the various mechanisms which would otherwise generate unwanted noise.

While not illustrated in FIGS. 9 and 10, one skilled in the art would readily recognize that a removable leg rest assembly similar to that previously described in conjunction with wall proximity reclining chair 210 and reclining rocking chair 10 could be incorporated into reclining gliding chair 310. As such, reclining, gliding chair 310 illustrated in FIGS. 9 and 10, could be readily adaptable to facilitate field serviceability and repair of a pantograph linkage incorporated therein.

The foregoing discussion discloses and describes various exemplary embodiments of the present invention. One skilled in the art will readily recognize from such discussion, and from the accompanying drawings and claims, that various changes, modifications and variations can be made therein without departing from the spirit and scope of the invention as defined by the following claims.

What is claimed is:

1. A reclining chair comprising:

a chair frame assembly including a pair of side frame members, a front cross member assembly including a front frame board and a pair of frame brackets secured to a forward portion of said side frame members, each of said frame brackets including a lower flange, an upper flange, and an aperture positioned directly behind said upper flange, said front frame board secured to said lower flange of said pair of frame brackets, and a rear cross rail member secured to a rear portion of said side frame members;

an actuation mechanism having a support shaft extending between said side frame members, said support shaft being disposed within the apertures of said frame brackets and secured to the upper flange thereof; and a seat assembly including a seat member pivotally interconnected to a seat back by a swing linkage mechanism, said swing linkage mechanism suspending said seat assembly within said side frame members to permit reclining movement of said seat assembly between an upright position and a reclined position.

2. The reclining chair of claim 1 wherein the aperture within each of said pair of frame brackets defines a slot for receiving opposite ends of said support shaft therein.

3. The reclining chair of claim 1 wherein said pair of frame brackets are metal components and said front frame board is a ply wood component.

4. The reclining chair of claim 1 further comprising:

said actuation mechanism including a drive rod extending between said side frame members; and a spacer link extending between said drive rod and said front frame board.

5. The reclining chair of claim 4 wherein said spacer link is secured to said support shaft.

6. The reclining chair of claim 5 further comprising a second spacer link extending between said drive rod and said front frame board.

7. The reclining chair of claim 1 further comprising:

a base assembly; and interconnection means for interconnecting said base assembly to said chair frame assembly for permitting relative motion therebetween.

8. The reclining chair of claim 7 wherein said interconnection means comprises a rocker assembly.

9. The reclining chair of claim 7 wherein said interconnection means further comprises:

a set of glide uprights extending from said base assembly; and a glide mechanism operably coupling said set of glide uprights with said chair frame assembly to permit gliding movement of said chair frame assembly with respect to base.

10. The reclining chair of claim 7 wherein said interconnection means further comprises:

a track secured to said base assembly; and a bearing link assembly operably coupled to said side frame members and having a pair of wheels engaging said track to permit translational movement of said chair frame assembly with respect to said base assembly.

11. The reclining chair of claim 10 wherein said interconnection means further comprises:

a stop bracket having a first vertical flange secured to said track and a first lateral flange extending from said first vertical flange; and a stop mount having a second vertical flange secured to an inner surface of one of said side frame members and a second lateral flange extending from said vertical flange;

whereby said first lateral flange engages said second lateral flange when said chair frame assembly is in a full, upright position to releaseably interconnect said chair frame assembly with said base assembly.

12. A reclining chair comprising:

a chair frame assembly including a pair of side frame members, a front cross member assembly having a pair of front frame brackets secured to a front portion of said side frame members and a front frame board secured to said pair of front frame brackets, and a rear cross rail member secured to a rear portion of said side frame members;

an actuation mechanism having a drive rod and a support shaft extending between said side frame members, said support shaft being secured to said front cross member assembly;

a seat assembly including a seat member pivotally interconnected to a seat back by a swing linkage mechanism, said swing linkage mechanism suspending said seat assembly within said side frame members to permit reclining movement of said seat assembly between an upright position and a reclined position; and a leg rest assembly including a drive link operably coupled to said drive rod for rotation therewith, a swing link bracket journally supported from said support shaft for rotation thereabout, a pantograph linkage having a support link releasably secured to said drive link and a swing link arm releasably secured to said swing link bracket such that said pantograph linkage is readily removably from said frame assembly, and a leg rest panel secured to an end of said pantograph linkage for coordinated articulated movement between a stowed position and an extended position in response to rotation of said drive rod.

13. The reclining chair of claim 12 wherein each of said pair of front frame brackets has a first lateral flange formed thereon for attaching said front frame board thereto and a second lateral flange formed thereon for securing said support shaft thereto.

14. The reclining chair of claim 12 wherein said front frame board has an aperture formed therein, said pantograph linkage extending through said aperture.

15. The reclining chair of claim 12 wherein said front frame board has a pair of arcuate recesses formed at an upper corner thereof adjacent said pair of front frame brackets.

16. The reclining chair of claim 12 further comprising a spacer link having a first end journally supported from said drive rod and a second end secured to said front frame board, said spacer link secured to said support shaft intermediate said first and second ends.

17. A leg rest assembly for use with an article of furniture having a seat assembly supported from a frame assembly and an actuation mechanism for enabling said leg rest assembly to move between a stowed position and an extended position, said leg rest assembly comprising:

a drive link operably coupled to said actuation mechanism for rotation;

a swing link bracket operably coupled to said frame assembly for rotation;

a swing link arm releasably secured to the swing link bracket for defining a two-piece swing link assembly;

a leg rest panel; and a pantograph linkage interdisposed between said leg rest panel and said actuation mechanism and supported by said swing link assembly for coordinated articulated movement between said stowed position and said extended position, said pantograph linkage including a support link releasably secured to said drive link;

whereby said pantograph linkage is readily removable from said frame assembly.

18. The leg rest assembly of claim 17 further comprising:

said actuation mechanism including a drive rod suspended within said frame assembly and supported thereby for rotation and a support shaft fixedly secured to said frame assembly;

said drive link engaging said drive rod for rotation therewith;

said swing link bracket journally supported from said support shaft for rotation thereabout.

19. The leg rest assembly of claim 18 wherein said swing link bracket includes a pair of flanges extending laterally outwardly to engage a pair of edge portions formed on said swing link arm.

20. The leg rest assembly of claim 19 wherein said swing link bracket and said swing link arm have an aperture formed therethrough for receiving a fastener to releasably secure said swing link bracket to said swing link arm.

* * * * *